US011158238B2

(12) United States Patent
Yamashita et al.

(10) Patent No.: US 11,158,238 B2
(45) Date of Patent: Oct. 26, 2021

(54) DISPLAY PANEL AND DRIVING METHOD THEREOF

(71) Applicant: Everdisplay Optronics (Shanghai) Co., Ltd., Shanghai (CN)

(72) Inventors: Keitaro Yamashita, Shanghai (CN); Lina Xiao, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 16/952,089

(22) Filed: Nov. 19, 2020

(65) Prior Publication Data

US 2021/0158743 A1 May 27, 2021

(30) Foreign Application Priority Data

Nov. 26, 2019 (CN) ..... 201911172054.5

(51) Int. Cl.
*G09G 3/20* (2006.01)

(52) U.S. Cl.
CPC ... *G09G 3/2092* (2013.01); *G09G 2300/0452* (2013.01); *G09G 2310/0275* (2013.01); *G09G 2310/0297* (2013.01)

(58) Field of Classification Search
CPC ..... G09G 3/2092; G09G 2310/0275; G09G 2300/0452; G09G 2310/0297
See application file for complete search history.

(56) References Cited

U.S. PATENT DOCUMENTS 7,830,591 B2 * 11/2010 Shimodaira ..... G02F 1/167 359/296
8,237,906 B2 * 8/2012 Igeta ..... G02F 1/1339 349/153
8,350,792 B2 * 1/2013 Igeta ..... G02F 1/136286 345/87
8,890,181 B2 * 11/2014 Wang ..... G07F 17/32 257/88
9,685,131 B2 * 6/2017 Tanaka ..... G09G 3/3666
9,940,888 B2 * 4/2018 Ryoo ..... G02F 1/136286
10,304,913 B2 * 5/2019 Choi ..... H01L 27/3276
10,418,434 B2 * 9/2019 Kim ..... H01L 27/3262
10,559,604 B2 * 2/2020 Zhan ..... H01L 27/124
10,580,803 B2 * 3/2020 Bei ..... H01L 27/3276
10,796,636 B2 * 10/2020 Kim ..... G09G 3/3266
10,802,366 B2 * 10/2020 Wu ..... G06F 3/0412
10,901,257 B2 * 1/2021 Li ..... G02F 1/13394
10,910,600 B2 * 2/2021 Park ..... H01L 51/5234
(Continued)

*Primary Examiner* — Michael J Jansen, II
(74) *Attorney, Agent, or Firm* — Qinghong Xu

(57) ABSTRACT

The present disclosure relates to the technical field of display devices, and provides a display panel and a driving method thereof. The display panel includes: a plurality of data lines, each of the data lines including a first segment line and a second segment line, every adjacent n+1 of the data lines forming a data line group, each data line group including a first data line having a connection line and n second data lines; a DEMUX circuit including n gating control lines, each of the gating control lines being in turn connected to the first segment line of the second data lines in each data line group, and the first segment line of each of the data lines in each data line group being connected to each other; and a driving IC connected to the second segment line of each of the data lines and the DEMUX circuit.

7 Claims, 7 Drawing Sheets

(56) References Cited

U.S. PATENT DOCUMENTS

| | | | | |
|---|---|---|---|---|
| 10,916,200 | B2 * | 2/2021 | Shin | H01L 27/124 |
| 10,923,028 | B2 * | 2/2021 | Lin | G02F 1/1339 |
| 2008/0117497 | A1 * | 5/2008 | Shimodaira | G02F 1/136286 359/296 |
| 2008/0225216 | A1 * | 9/2008 | Shimodaira | G02F 1/1362 349/143 |
| 2009/0051636 | A1 * | 2/2009 | Natori | G09G 3/3648 345/87 |
| 2010/0026611 | A1 * | 2/2010 | Igeta | G02F 1/136286 345/55 |
| 2010/0060842 | A1 * | 3/2010 | Igeta | G02F 1/13394 349/153 |
| 2014/0197428 | A1 * | 7/2014 | Wang | G07F 17/32 257/88 |
| 2016/0019856 | A1 * | 1/2016 | Tanaka | G09G 3/3677 345/206 |
| 2017/0110041 | A1 * | 4/2017 | Watsuda | G09G 3/20 |
| 2017/0154566 | A1 * | 6/2017 | Ryoo | G02F 1/13 |
| 2017/0162637 | A1 * | 6/2017 | Choi | G09G 3/20 |
| 2017/0288003 | A1 * | 10/2017 | Kim | H01L 27/124 |
| 2018/0129111 | A1 * | 5/2018 | Wu | G02F 1/13454 |
| 2019/0051670 | A1 * | 2/2019 | Bei | H01L 27/3276 |
| 2019/0123066 | A1 * | 4/2019 | Zhan | H01L 27/1218 |
| 2019/0197949 | A1 * | 6/2019 | Kim | G09G 3/3266 |
| 2019/0362678 | A1 * | 11/2019 | Shin | H01L 27/124 |
| 2020/0110298 | A1 * | 4/2020 | Li | G02F 1/133514 |
| 2020/0235342 | A1 * | 7/2020 | Park | H01L 51/5234 |
| 2020/0349886 | A1 * | 11/2020 | Lin | G02F 1/136286 |

* cited by examiner

DISPLAY PANEL AND DRIVING METHOD THEREOF

CROSS-REFERENCE TO RELATED APPLICATIONS

The present application is based upon and claims priority of Chinese Patent Application No. 201911172054.5, filed on Nov. 26, 2019, the contents of which are hereby incorporated by reference in its entirety.

TECHNICAL FIELD

The present disclosure relates to the technical field of display devices, and in particular, to a display panel and a driving method thereof.

BACKGROUND

At present, the mobile phone market has increasing requirements on the diversity and special shape of panels. Compared with general quadrilateral panels, the layout of the special-shaped panel is also more difficult, which is a technical challenge for the design and manufacturing process.

It should be noted that the information applied in the Background section above is only used to enhance the understanding of the background of the present disclosure, and therefore may include information that does not constitute the prior art known to those skilled in the art.

SUMMARY

In view of this, the present disclosure provides a display panel and a driving method thereof.

According to an aspect of the present disclosure, a display panel is provided, including: a hole area a pixel array, which is arranged in a plurality of rows and columns bypassing the hole area; a plurality of data lines, wherein each of the data lines is correspondingly connected to a column of pixels, each of the data lines includes a first segment line and a second segment line respectively located above and below the hole area and extended along the column direction, every adjacent n+1 of the data lines forms a data line group, each data line group includes a first data line and n second data lines, and the first data line has a connection line connected to the first segment line and the second segment line thereof and extended along a side edge of the hole area; a DEMUX circuit, including n gating control lines, wherein each of the gating control lines is in turn connected to the first segment line of the second data line in each data line group, and the first segment line of each of the data lines in each data line group is connected to each other; a driving IC, connected to the second segment line of each of the data lines and the DEMUX circuit, wherein the driving IC is configured to individually gate each of the first data lines and gate each of the second data lines through the first data line in each data line group and the DEMUX circuit.

Optionally, in the display panel, a first one of the data lines in each data line group is the first data line, and an i-th gating control line of the DEMUX circuit is sequentially connected to the first segment line of an i-th second data line in each data line group through a switch, wherein i is a positive integer from 1 to n.

Optionally, in the display panel, at a side edge of the hole area, a wiring width L of all connection lines along a row direction is:

$$L = \frac{3DW}{2P(n+1)},$$

wherein D is an outer diameter of the hole area along the row direction, W is sum of width of one of the connection lines along the row direction and distance of adjacent two of the connection lines along the row direction, and P is distance of adjacent two of the pixels along the row direction.

Optionally, in the display panel, the switch is a triode, and a control terminal thereof is connected to a corresponding gating control line, and a first electrode and a second electrode are respectively connected to a first segment line of a corresponding second data line and a first segment line of a corresponding first data line.

Optionally, in the display panel, the triode is a thin film transistor, a control terminal thereof is a gate electrode, and a first electrode and a second electrode are a source electrode and a drain electrode, respectively.

Optionally, in the display panel, each of the data lines is correspondingly connected to a column of pixels with same color.

Optionally, in the display panel, the hole area is disposed in an effective light emitting area of the display panel, the DEMUX circuit is disposed in an upper frame area of the display panel, and the driving IC is disposed in a lower frame area of the display panel.

According to another aspect of the present disclosure, a driving method for a display panel is provided for driving the above display panel. The driving method includes: gating, by the driving IC, the second segment line of the second data line according to a gating signal of the second data line, and meanwhile sending a signal for gating the first segment line of the second data line to the DEMUX circuit, to gate the first segment line of the second data line through the first data line in the data line group where the second data line is located and the DEMUX circuit and gating, by the driving IC, the first data line according to a gating signal of the first data line; and.

BRIEF DESCRIPTION OF THE DRAWINGS

The drawings herein, which are incorporated in and constitute a part of this specification, illustrate embodiments consistent with the present disclosure, and together with the description serve to explain the principles of the present disclosure. Obviously, the drawings in the following description are only some embodiments of the present disclosure. For those of ordinary skill in the art, other drawings can be obtained based on these drawings without creative efforts.

DETAILED DESCRIPTION

Figure 1:
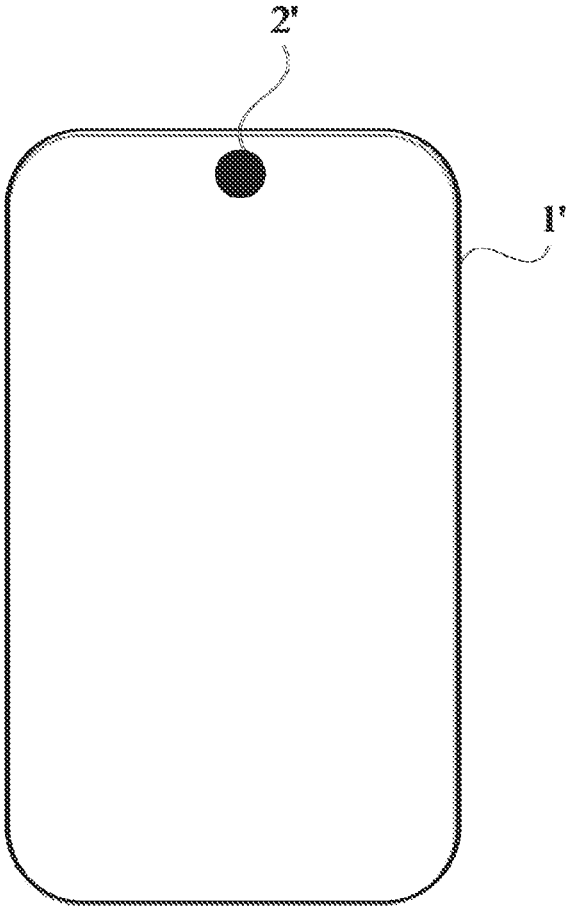
FIG. 1 shows a schematic diagram of a display panel in the prior art.

Example embodiments will now be described more fully with reference to the accompanying drawings. However, the exemplary embodiments can be implemented in various forms and should not be construed as being limited to the embodiments set forth herein. Rather, these embodiments are provided so that this disclosure will be thorough and complete, and will fully convey the concept of example embodiments to those skilled in the art. The same reference numerals in the drawings denote the same or similar structures, and their repeated description will be omitted.

As shown in FIG. 1, in order to meet the needs of the model, a circular or special-shaped hole 2' needs to be dug at a position on the display panel 1'. When wiring the display panel 1', the wiring of data lines around the hole 2' need to bypass the hole 2', which results in the wiring area around the hole 2', that is, the ineffective light emitting area, is particularly large, which affects not only the display effect but also the overall aesthetics of display panel 1'.

Figure 2:
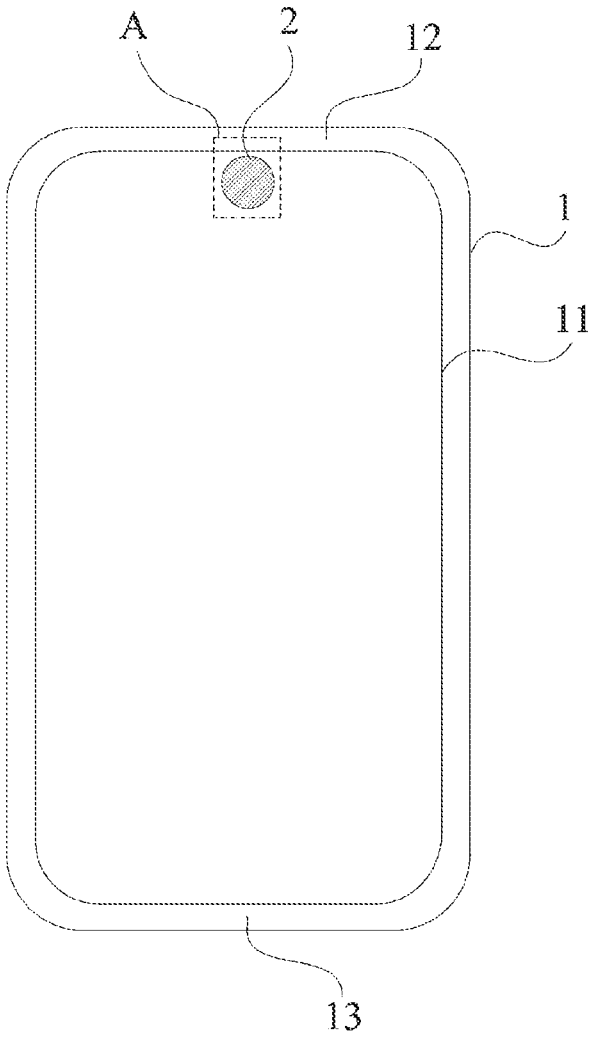
FIG. 2 shows a schematic diagram of a display panel in an embodiment of the present disclosure.
Figure 3:
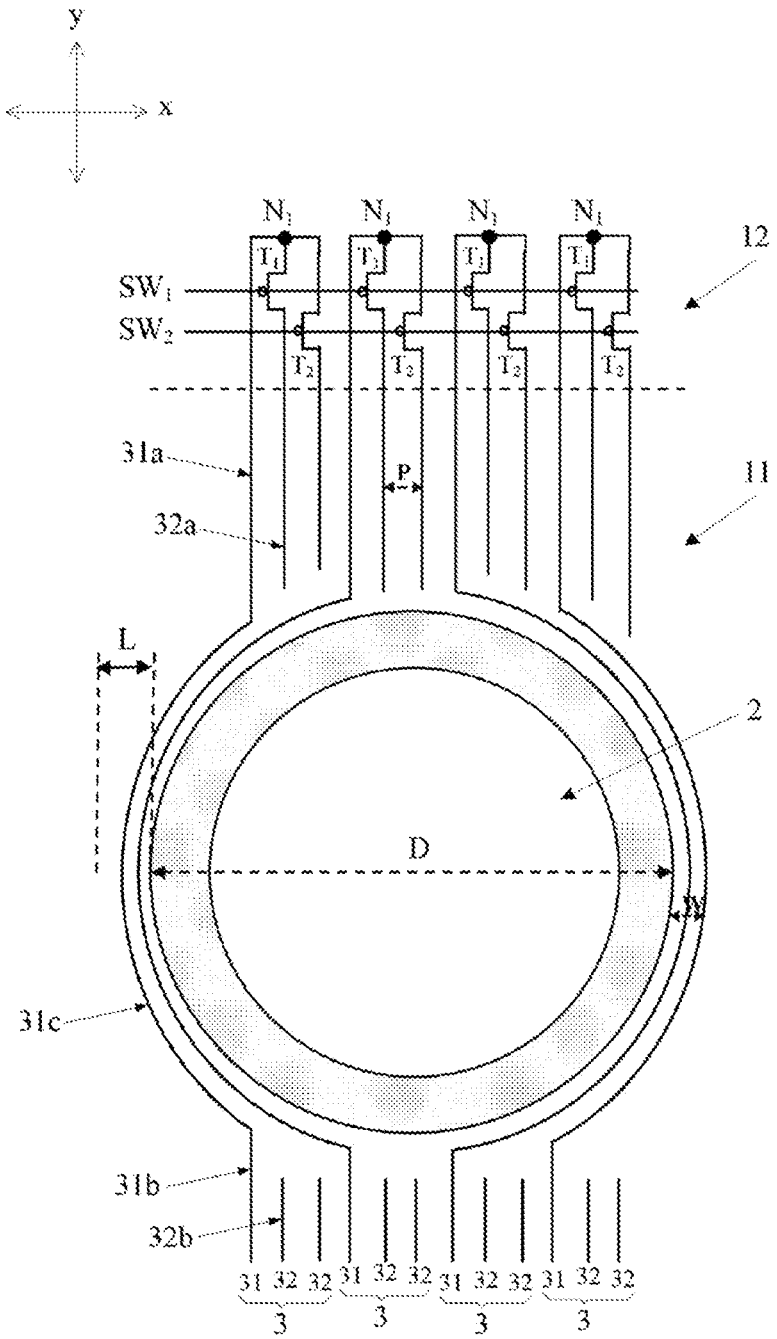
FIG. 3 is a partially enlarged view of FIG. 2, showing a schematic layout of data lines around a hole area.
Figure 4:
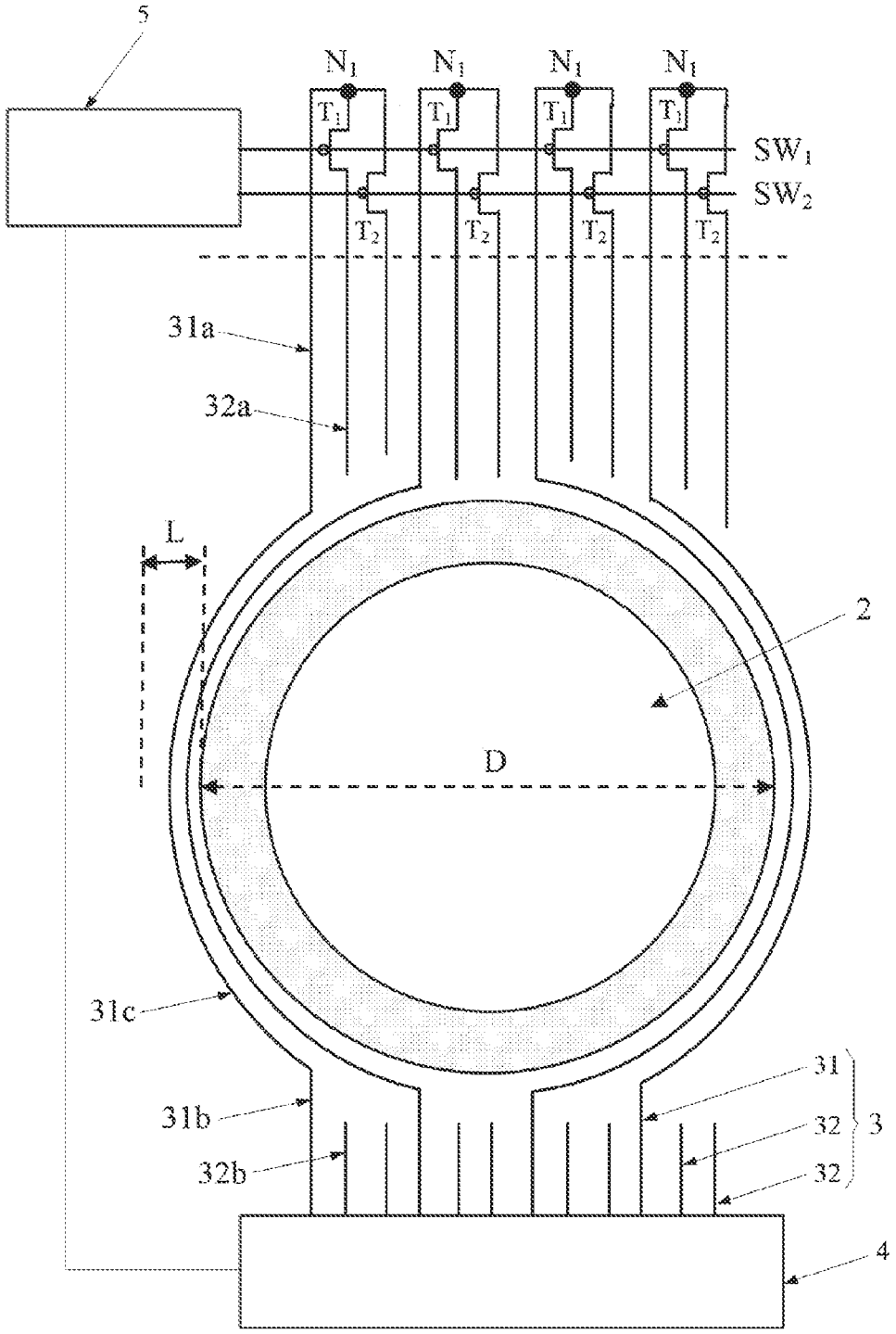
FIG. 4 is a schematic diagram of gating control of the data lines around the hole area in FIG. 3.

The display panel of the present disclosure can be used in electronic products such as mobile phones and tablet computers. In the drawings, a mobile phone style is taken as an example for description, but the present disclosure is not limited thereto. With reference to FIGS. 2 to 4, FIG. 2 shows a general structure of the display panel in this embodiment, and FIG. 3 is a partially enlarged view of the area of a dotted frame A in FIG. 2, showing a schematic layout of data lines around a hole area, and FIG. 4 is a schematic diagram of gating control of the data lines around the hole area in FIG. 3. The display panel 1 specifically includes:

A hole area 2. The number of the hole areas 2 is determined according to design requirements, and the positions can be set in any area of the display panel 1 as needed. In practical applications, the hole area 2 can be used to place a camera and other components, so it is disposed in an upper area of the display panel 1 as shown in the figure.

A pixel array, bypassing the hole area 2 and being arranged in a plurality of rows and columns in a display area 11 of the display panel 1. The pixel array is not specifically shown in the figure. Except that there are no pixels in the hole area 2, the display panel 1 has a pixel array with plurality of rows and columns formed in the display area 11 with existing pixel arrangement.

A plurality of data lines, each of the data lines corresponds to a column of pixels, each of the data lines includes a first segment line and a second segment line respectively located above and below the hole area 2 and extended along a column direction y, every adjacent n+1 of the data lines form a data line group 3, each of the data line groups 3 includes a first data line 31 and n second data lines 32, the first data line 31 has a connection line 31*c* connected to a first segment line 31*a* and a second segment line 31*b* and extended along a side edge of the hole area 2, and the second data line 32 includes a first segment line 32*a* and a second segment line 32*b* respectively located above and below the hole area 2 and extended along the column direction y.

With reference to the drawings, the data lines around the hole area 2 specifically include a plurality of first data lines 31 and a plurality of second data lines 32, wherein n second data lines 32 are distributed between every adjacent two of the first data lines 31, each of the first data lines 31 and n second data lines 32 form a data line group 3. The figure shows only part of the first data lines 31 and the second data lines 32. Each of the data lines corresponds to a column of pixels. When the pixel arrangement is that each of the column of pixels has a same color, each of the data lines corresponds to the column of pixels with the same color. Each of the first data lines 31 includes a first segment line 31*a* and a second segment line 31*b* respectively located above and below the hole area 2 and extended along the column direction y, and a connection line 31*c* connected to the first section line 31*a* and the second section line 31*b* extended along a side edge of the hole area 2. The first data line 31 is a complete data line, wherein the first segment line 31*a* and the second segment line 31*b* correspond to a column of pixels located above and below the hole area 2 respectively, and the connection line 31*c* is connected to the first segment line 31*a* and the second segment line 31*b* for signal transmission. Each of the second data lines 32 includes a first segment line 32*a* and a second segment line 32*b* respectively located above and below the hole area 2 and extended along the column direction y. The second data line 32 is designed as two separated lines, and there is no connection line connected to the first line 32*a* and the second line 32*b*. In this way, the wiring area around the hole area 2, specifically, the wiring area at the sides of the hole area 2 can be greatly reduced. When the more the number of the second data lines 32 distributed between every adjacent two of the first data lines 31, that is, the larger the value of n, the more the wiring area on the side of the hole area 2 is reduced, so that the ineffective light emitting area in the display panel 1 can also be greatly reduced.

The DEMUX circuit includes n gating control lines, each of the gating control lines is in turn connected to a first segment line 32*a* of a second data line 32 in respective data line groups 3, and the first segment line of each of data lines in each of the data line groups 3 is connected to each other.

In an embodiment, in each of data line groups 3, the first one of data lines is the first data line 31, and the remaining n data lines are the second data lines 32. The DEMUX circuit includes n gating control lines $SW_1$~$SW_n$ respectively extended along the row direction x, wherein an i-th gating control line SWi is connected to the first segment line 32*a* of the i-th second data line 32 in each of the data line groups 3 through a switch, where i is a positive integer from 1 to n; and in each of the data line groups 3, the first segment line 32*a* of each of the second data lines 32 is connected to the first segment line 31*a* of the first data line 31 through the switch, respectively. The figure shows two gating control lines $SW_1$ and $SW_2$, wherein, through a switch T1, the gating control line $SW_1$ is connected to a first one of the second data line 32 in each data line group 3, that is, the second data line 32 adjacent to the first data line 31 in the data line group 3; through a switch T2, the gating control line $SW_2$ is connected to a second one of the second data line 32 in each data line group 3, that is, the second data line 32 adjacent to the first one of the second data line 32 in the data line group 3 described above. Through the gating control line $SW_1$ and each of the switches T1 connected thereto, the first one of the second data line 32 in each of the data line groups 3 can be controlled; through the gating control line $SW_2$ and each of the switches T2 connected thereto, the second one of the second data line 32 in each of the data line groups 3 can be controlled. In addition, in each of the data line groups 3, the first segment line 32*a* of the first one of the second data line 32 is connected to the first segment line 31*a* of the first data line 31 through the switch T1, referring to connection nodes N1 in each of the data line groups 3 marked in the figure. In each of the data line groups 3, the first segment line 32*a* of the second one of the second data line 32 is directly connected to the first segment line 31*a* of the first data line 31 through the switch T2. When each of the data line groups 3 includes three, four, five, six . . . second data lines 32, the DEMUX circuit will accordingly include gate control lines $SW_3$, $SW_4$, $SW_5$, $SW_6$ . . . which is not repeated here.

The DEMUX is a demultiplexer, which can realize that a channel is selected from a plurality of channels for signal transmission according to a trigger signal. As in the display panel 1 described above, the DEMUX circuit can be used to select one of the second data lines 32 from the two second data lines 32 in each of the data line groups 3 to make the switch turned on, and to realize signal transmission. In other embodiments, by changing the value of n of the DEMUX circuit, where n is a positive integer, one of the second data lines 32 can be selected from the n second data lines 32 in each of the data line groups 3 to make the switch turned on and to realize signal transmission.

A driving IC 4, connected to the second segment line of each of the data lines and the DEMUX circuit, wherein the driving IC 4 is configured to individually gate each of the first data lines 31 and gate each of the second data lines 32 through the first data line 31 in each data line group 3 and the DEMUX circuit. Specifically, the DEMUX circuit may include a control module 5 for receiving a signal from the driving IC 4 to gate a corresponding second data line 32. When the first data line 31 needs to be gated, the first data line 31 can be gated directly through the driving IC 4. When a second data line 32 needs to be gated, the second segment 32*b* of the second data line 32 is gated through the driving IC 4, meanwhile, the control module 5 of the DEMUX circuit will receive a signal for gating the first segment line 32*a* of the second data line 32, so that the driving IC 4 can gate the first segment line 32*a* of the second data line 32 through the first data line 31 in the data line group 3 where the second data line 32 is located and the DEMUX circuit, so that the first segment line 32*a* and the second segment line 32*b* of the second data line 32 are simultaneously gated.

The specific operating principle of the control IC 4 may adopt an existing design, and the present disclosure does not limit this. In the display panel 1 of the present disclosure, by using the DEMUX circuit in the layout of the data lines, part of the data lines around the hole area 2, that is, the first data lines 31, extend along the side edge of the hole area 2 and occupies part of the light emitting area around the hole area 2; while other data lines around the hole area 2, that is, the second data lines 32, do not occupy the light emitting area around the hole area 2. The second data lines 32 are controlled through the driving IC 4 and use the DEMUX circuit and the first data line 31 corresponding to the data line groups 3 for gating. Therefore, the wiring occupying the light emitting area around the hole area 2 is greatly reduced, and the purpose of reducing the ineffective light emitting area of the display panel 1 is achieved.

After the data lines are arranged using the DEMUX circuit, at a side edge of the hole area 2, a wiring width L of all of the connection lines 31*c* along the row direction x is:

$$L = \frac{3DW}{2P(n+1)},$$

wherein D is an outer diameter of the hole area 2 along the row direction x, the hole area 2 generally includes a hole and a sealant disposed around the hole, and D is an outer diameter of the hole area 2 including the width of the sealant. The hole area 2 shown in this embodiment is circular. In other embodiments, the hole area 2 can be set into different shapes according to design requirements, and the outer diameter of the hole area is also the width along the row direction x. W is the sum of the width of one of the connection lines 31*c* along the row direction x and the distance between adjacent two of the connection lines 31*c* along the row direction x, which is regarded as the width occupied by each of the connections line 31*c*; P is the distance between adjacent two of the pixels along the row direction x, that is, a repeating array distance of the data lines. In the display panel 1, the outer diameter D of the hole area 2 along the row direction x, the width W occupied by each of the connection lines 31*c*, and the distance P between adjacent two of the pixels along the row direction x are configured according to parameter of the display panel 1, which can be regarded as fixed values. Accordingly, The relationship between the wiring width L around the hole area 2 and the value n of the DEMUX circuit is:

$$L = \frac{3DW}{2P(n+1)} = \frac{K}{n+1}.$$

Figure 5:
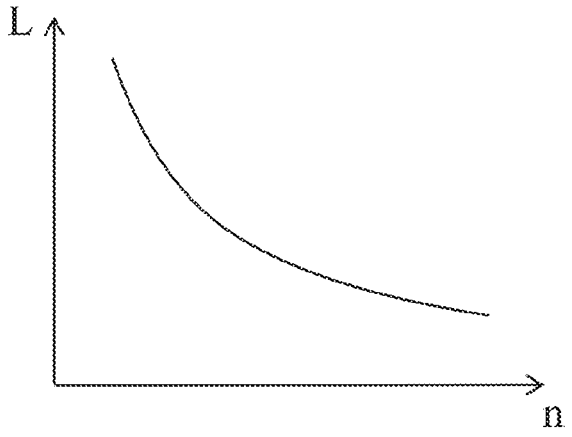
FIG. 5 shows an equivalent graph of wiring width L around a hole area to the value n of the DEMUX circuit.

Referring to an equivalent graph of the wiring width L around the hole area 2 to the value n of the DEMUX circuit shown in FIG. 5, the wiring width L around the hole area 2 is roughly inversely proportional to the value n of the DEMUX circuit, that is, the larger the value n of the DEMUX circuit, the more the number of the second data lines 32 distributed between every adjacent two of the first data lines 31, and the more the wiring area of the connection line 31*c* on the side of the hole area 2 decreases, so that the ineffective light emitting area of the display panel 1 can be greatly reduced.

Figure 6:
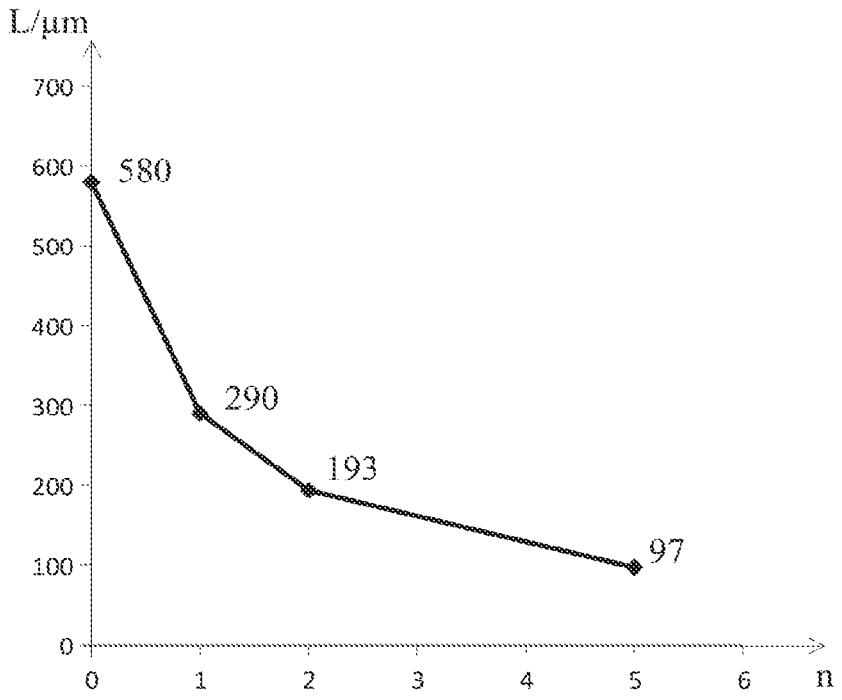
FIG. 6 shows a relationship between the wiring width L around a hole area and several different values n of the DEMUX circuit.

In a specific application example, the outer diameter D of the hole area 2 along the row direction x is 5 mm, the width W occupied by each of the connection lines 31*c* is 6 μm, and the distance P between adjacent two of the pixels along the row direction x is 78 μm. The wiring width L around the hole area 2 is calculated to be about 580/(n+1) μm. FIG. 6 shows the relationship between the wiring width L around the hole area and several different values n of the DEMUX circuit. As described in the above embodiment, when the value of n of the DEMUX circuit is set to 2, the wiring width L around the hole area 2 is about 193 μm, which is about 67% smaller than the wiring width of 580 μm around the hole area where the DEMUX circuit is not disposed. In other embodiments, if the value n of the DEMUX circuit is set to 1, the wiring width L around the hole area 2 will be about 290 μm, which will be about 50% smaller than the wiring width of 580 μm around the hole area where the DEMUX circuit is not disposed. If the value n of the DEMUX circuit is 5, the wiring width L around the hole area 2 will be about 97 μm, which will be about 83% smaller than the wiring width of 580 μm around the hole area where the DEMUX circuit is not disposed. When the value n of the DEMUX circuit takes other different values, the wiring width L around the hole area 2 will be reduced correspondingly to a different extent, so that the ineffective light emitting area of the display panel 1 is reduced.

In an embodiment, as shown in FIG. 3, each of the switches T1 and T2 is a triode, having a control terminal connected to the gate control line SW1/SW2 of the DEMUX circuit, and a first electrode and a second electrode respectively connected to the first segment line 32*a* of the second data line 32 and the first segment line 31*a* of the first data line 31. Optionally, the triode is a thin film transistor, in which a control terminal is a gate electrode, and a first electrode and a second electrode are a source electrode and a drain electrode, respectively. When the gating control line SW1 transmits a trigger signal that can turn on the switches, each of the switches T corresponding to each of the data line groups 3 is turned on, so that each of the second data lines 32 connected to the switch T1 realizes gating for signal transmission. When the gating control line SW2 transmits a trigger signal that can turn on the switches, each of the switches T2 corresponding to each of the data line groups 3 is turned on, so that each of the second data lines 32 connected to the switch T2 realizes gating for signal transmission.

In an embodiment, referring to FIG. 2, the hole area 2 is disposed in an effective light emitting area 11 of the display panel 1, and the DEMUX circuit is disposed in an upper frame area of the display panel 1 so as not to occupy the effective light emitting area of the display panel 1. The control IC 4 has a conventional design and is located in a lower frame area 13 of the display panel 1. The configuration of the driving IC 4 is a prior art of the display panel 1 and is not specifically shown in the figure. The present disclosure improves the way of gating the data lines around the hole area 2 through the driving IC 4. For details, refer to the description of the foregoing embodiment. The remaining data lines of the display panel 1 are connected to the driving IC 4, and the driving IC 4 controls signal transmission of each of the data lines. The extension of the remaining data lines does not involve the hole area 2, and there is no need for winding and gating through the DEMUX circuit, and the traditional design is used, so it will not be described in detail. Scanning circuits are disposed on both left and right sides of the display panel 1, so around the hole area 2, scanning lines can be set on both sides of the hole area 2, respectively, which are controlled by the scanning circuits on both sides, without the need for a DEMUX circuit. The scanning lines can also be wiring by using the above-mentioned data line layout. The principle and structure are the same as those of the above-mentioned embodiment, so the description will not be repeated.

Figure 7:
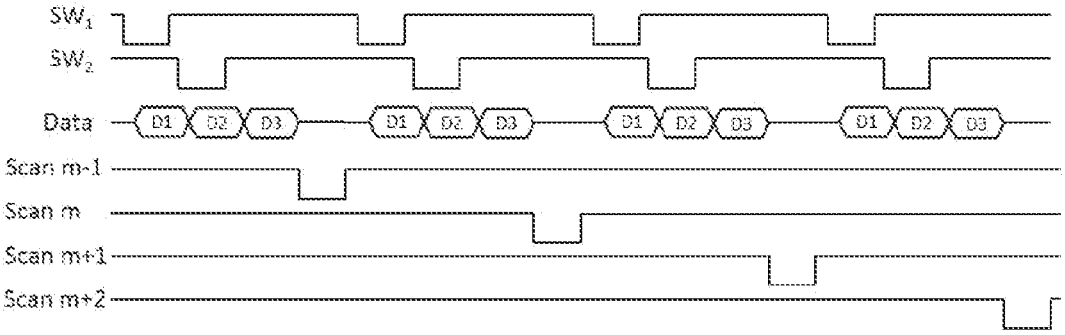
FIG. 7 shows a driving timing chart of a driving method of a display panel in an embodiment of the present disclosure.

In an embodiment of the present invention, there is also provided a driving method for driving the display panel 1 described in the foregoing embodiment. FIG. 7 shows a driving timing diagram of the driving method. In combination with FIG. 7 and FIG. 3 and FIG. 4, SW1 is the first gate control line of the DEMUX circuit, SW2 is the second gate control line of the DEMUX circuit, Data represents a data bus in the driving IC for transmitting data line driving signals, D1 signal is used to drive the first one of the second data line 32 in each of the data line groups 3, and D1 signal corresponds to a signal on the gating control line SW1. D2 signal is used to drive the second one of the second data line 32 in each of the data line groups 3, and D2 signal corresponds to a signal on the gate control line SW2. D3 signal is used to drive a first data line 1 in each of the data line groups 3. The D1 to D3 signals correspond to pixels of driving one color, respectively. Scan m−1 to Scan m+2 are each of the scan lines. In each frame period, take pixels at the row of Scan m as an example, before Scan m is turned on, turn on each of the data lines in turn, to charge the data to be written on each of the data lines, and then the Scan m is turned on, and the data held on each of the data lines starts to be written to the corresponding pixel.

With reference to the display panel 1 described above, the steps of sequentially turning on each of the data lines around the hole area 2 include:

According to a gating signal of the second data line 32, the second segment line 32*b* of the second data line 32 is gated through the driving IC, and a signal of gating the first segment 32*a* of the second data line 32 is sent to the DEMUX circuit, for gating the first segment line 32*a* of the second data line 32 through the first data line 31 in each of the data line groups 3 where the second data line 32 is located and the DEMUX circuit. Take gating the first second data line 32 in the leftmost one of the data line groups 3 in FIG. 4 as an example, the second segment 32*b* of the second data line 32 located below the hole area 2 is gated through the driving IC 4, and the first segment line 32*a* of the second data line 32 located above the hole area 2 is gated through the gate control line SW1 of the DEMUX circuit. Specifically, the first data line 31 in the data line group 3 to which the second data line 32 belongs is gated through the driving IC, and the gate control line SW1 is controlled to turn on the switch T1 connected to the first segment line 32*a* of the second data line 32, thereby connecting the first data line 31 with the first segment line 32*a* of the second data line 32 through the switch T1. Therefore, the first segment line 32*a* and the second segment line 32*b* of the second data line 32 are both gated. Gating the other second data lines 32 is in a same way, so the description will not be repeated.

According to a gating signal of the first data line 31, the first data line 31 is gated through the driving IC. The first data line 31 is formed as a complete data line by the second segment line 31*b*, the connection line 31*c*, and the first segment line 31*a*, so that the first data line 31 can be directly gated through the driving IC.

The display panel and the driving method of the present disclosure adopt the DEMUX circuit in the data line layout, so that part of the data lines around the hole area, that is, the first data lines, extend along the side edge of the hole area, and occupy part of the light emitting area around the hole area. The other data lines around the hole area, that is, the second data lines, do not occupy the light emitting area around the hole area. These second data lines are controlled through the driving IC and are gated using the DEMUX circuit and the first data line corresponding to the data line group. Therefore, the wiring occupying the light emitting area around the hole area is greatly reduced, and the purpose of reducing the ineffective light emitting area of the display panel is achieved.

Compared with the prior art, the beneficial effects of the present disclosure include at least:

The present disclosure uses a DEMUX circuit for data line layout, so that part of data lines around a hole area, that is, the first data lines, extend along a side edge of the hole area, and occupy part of light emitting area around the hole area, while other data lines around the hole area, that is, the second data lines, do not occupy the light emitting area around the hole area, and the second data lines are controlled by the driving IC, and use the DEMUX circuit and the first data line in the corresponding data line group to realize gating. Therefore, a wiring area occupying the light emitting area around the hole area is greatly reduced, and the purpose of reducing the ineffective light emitting area of the display panel is achieved.

The above content is a further detailed description of the present disclosure in combination with specific preferred embodiments, and it cannot be considered that the specific implementation of the present disclosure is limited to these descriptions. For those of ordinary skill in the technical field to which the present disclosure belongs, without deviating from the concept of the present disclosure, several simple deductions or replacements can be made, which should all be regarded as belonging to the protection scope of the present disclosure.

What is claimed is:

1. A display panel, comprising:

a hole area;

a pixel array, which is arranged in multiple rows and columns bypassing the hole area;

a plurality of data lines, wherein each of the data lines is correspondingly connected to a column of pixels, each of the data lines comprises a first segment line and a second segment line respectively located above and below the hole area and extended along the column direction, every adjacent n+1 of the data lines forms a data line group, each data line group comprises a first data line and n second data lines, and the first data line has a connection line connected to the first segment line and the second segment line thereof and extended along a side edge of the hole area;

a DEMUX circuit, comprising n gating control lines and a control module, wherein the DEMUX circuit is configured such that each of the gating control lines is in turn connected to the first segment line of the second data line in each data line group, and the first segment line of each of the data lines in each data line group is connected to each other; and a driving IC, connected to the second segment line of each of the data lines and the DEMUX circuit, wherein the driving IC can individually gate each of the first data lines and gate each of the second data lines through the first data line in each data line group and the DEMUX circuit, wherein the control module is configured to receive a signal from the driving IC to gate a corresponding second data line; and wherein a wiring width L of all connection lines along a row direction is:

$$L = \frac{3DW}{2P(n+1)},$$

wherein D is an outer diameter of the hole area along the row direction, W is sum of width of one of the connection lines along the row direction and distance of adjacent two of the connection lines along the row direction, and P is distance of adjacent two of the pixels along the row direction.

2. The display panel according to claim 1, wherein, a first one of the data lines in each data line group is the first data line, and an i-th gating control line of the DEMUX circuit is sequentially connected to the first segment line of an i-th second data line in each data line group through a switch, wherein i is a positive integer from 1 to n.

3. The display panel according to claim 1, wherein, the switch is a triode, and a control terminal thereof is correspondingly connected to a gating control line, and a first electrode and a second electrode are correspondingly connected to the first segment line of the second data line and the first segment line of the first data line, respectively.

4. The display panel according to claim 3, wherein, the triode is a thin film transistor, a control terminal thereof is a gate electrode, and a first electrode and a second electrode are a source electrode and a drain electrode, respectively.

5. The display panel according to claim 1, wherein, the hole area is disposed in an effective light emitting area of the display panel, the DEMUX circuit is disposed in an upper frame area of the display panel, and the driving IC is disposed in a lower frame area of the display panel.

6. The display panel according to claim 1, wherein, each of the data lines is correspondingly connected to a column of pixels with same color.

7. A driving method for a display panel, being used for driving the display panel comprising:

a hole area;

a pixel array, which is arranged in multiple rows and columns bypassing the hole area;

a plurality of data lines, wherein each of the data lines is correspondingly connected to a column of pixels, each of the data lines comprises a first segment line and a second segment line respectively located above and below the hole area and extended along the column direction, every adjacent n+1 of the data lines forms a data line group, each data line group comprises a first data line and n second data lines, and the first data line has a connection line connected to the first segment line and the second segment line thereof and extended along a side edge of the hole area;

a DEMUX circuit, comprising n gating control lines and a control module, wherein the DEMUX circuit is configured such that each of the gating control lines is in turn connected to the first segment line of the second data line in each data line group, and the first segment line of each of the data lines in each data line group is connected to each other; and a driving IC, connected to the second segment line of each of the data lines and the DEMUX circuit, wherein the driving IC can individually gate each of the first data lines and gate each of the second data lines through the first data line in each data line group and the DEMUX circuit, wherein the control module is configured to receive a signal from the driving IC to gate a corresponding second data line; and wherein a wiring width L of all connection lines along a row direction is:

$$L = \frac{3DW}{2P(n+1)},$$

wherein D is an outer diameter of the hole area along the row direction, W is sum of width of one of the connection lines along the row direction and distance of adjacent two of the connection lines along the row direction, and P is distance of adjacent two of the pixels along the row direction;

wherein, the driving method comprises:

gating, by the driving IC, the second segment line of the second data line according to a gating signal of the second data line, and meanwhile sending a signal for gating the first segment line of the second data line to the DEMUX circuit, to gate the first segment line of the second data line through the first data line in the data line group where the second data line is located and the DEMUX circuit; and gating, by the driving IC, the first data line according to a gating signal of the first data line.

* * * * *